US006668396B2

(12) United States Patent
Wei

(10) Patent No.: US 6,668,396 B2
(45) Date of Patent: Dec. 30, 2003

(54) TURNING MECHANISM FOR A PATIENT CONFINED TO A BED

(76) Inventor: Ching-Hua Wei, 14Fl.-2, No. 8, Lane 340, Junghua 2nd Rd., Yungkang City (TW)

( * ) Notice: Subject to any disclaimer, the term of this patent is extended or adjusted under 35 U.S.C. 154(b) by 0 days.

(21) Appl. No.: 10/322,548

(22) Filed: Dec. 19, 2002

(65) Prior Publication Data

US 2003/0121098 A1 Jul. 3, 2003

(30) Foreign Application Priority Data

Dec. 28, 2001 (TW) ..... 90132668 A

(51) Int. Cl.[7] ..... A61G 7/00
(52) U.S. Cl. ..... 5/81.1 R; 5/84.1; 5/509.1
(58) Field of Search ..... 5/81.1 R, 84.1, 5/607, 660, 509.1

(56) References Cited

U.S. PATENT DOCUMENTS 4,654,903 A * 4/1987 Chubb et al. ..... 5/607
4,819,282 A * 4/1989 McArthur et al. ..... 5/610
4,856,129 A * 8/1989 Butler ..... 5/610

* cited by examiner

*Primary Examiner*—Teri Pham Luu
*Assistant Examiner*—Fredrick Conley
(74) *Attorney, Agent, or Firm*—Rosenberg, Klein & Lee

(57) ABSTRACT

A turning mechanism for a patient confined to a bed includes two movable frames, and two adjusting members connected to respective frames for moving the frames between a horizontal position and a tilted position. A sheet is connected to elongated rods of the frames by an easily detachable device. Thus, a patient lying on the sheet can be turned between a back-rest position and left and right side rest positions. The adjusting members have transmission shafts, which have threaded sections having moving blocks movable along; Propping rods are pivoted to the moving blocks at first ends. The propping rods are pivoted to the frames at the other ends so that when power source is activated, the moving blocks move along threaded sections, and the propping rods are moved to raise the respective frames to a tilted position.

10 Claims, 6 Drawing Sheets

TURNING MECHANISM FOR A PATIENT CONFINED TO A BED

BACKGROUND OF THE INVENTION

1. Field of the Invention

The present invention relates to a turning mechanism for a patient confined to a bed, more particularly a turning mechanism for a patient, which is relatively uncomplicated in structure, and convenient to use.

2. Brief Description of the Prior Art

It is necessary for the position of a patient confined to a bed and unable to turn himself or herself to be periodically changed by nurses or people providing care to a patient to prevent bedsores, pressure sores and other maladies associated with lying in one position for a long period of time. In addition, nurses or people providing care to a patient have to frequently change the position of the patient in bed when washing, dressing and undressing the patient and in providing other care. To prevent a bedridden patient from lying on the bed in a fixed position for an extended period of time, people providing care periodically turn the patient between the back-rest position and side-rest positions, which can be a left side-rest position or a right side-rest one, for allowing the patient to rest on the bed in each of the different positions for a certain period of time.

Therefore, the nurses or people providing care to an invalid patient would spend relatively much labor if they have to turn the patient manually without assistance device. Turning devices have been provided for allowing nurses or people, providing care to a bedridden patient, to turn the patient between the various rest positions with reduced labor and length of time.

U.S. Pat. No. 5,155,874 disclosed a "Turn sheet for invalid", which includes a lift device 12, chains 70, and bars 66, and a turn sheet 10, which is turned with the lift device 12 working with the chains 70, and the bars 66. This mechanism only allows the patient to be turned to single side rest position. The lift device 12 has to be separated from the turn sheet 10, and then moved to the other side of the bed, and finally connected to the other side of the turn sheet 10 for allowing the patient to be turned to the other side rest position. Therefore, this mechanism is not convenient to use.

U.S. Pat. No. 5,161,267 disclosed a "Method for lifting and turning a patient confined to a bed", which allows a patient to be turned to both side rest positions. However, the mechanism used in this method has relatively complicated structure, and the patient lying on the bed is enclosed by an upper section of the mechanism, which is likely to interfere with medical staff's providing service to the patient.

U.S. Pat. No. 5,274,862 disclosed a "Patient turning device and method for lateral traveling transfer system", which have straps 54 passed over two sides of a patient for turning the patient between various positions. This device has relatively uncomplicated but pulling force of the straps 54 is concentrated on the middle of the patient, may cause stress concentration and discomfort to the patient.

U.S. Pat. No. 5,524,304 disclosed a "Bed rail mounted drive unit for patient positioner", which is equipped with straps 20, 22. This device has similarly drawback as the last one, and could cause uneven rotation and discomfort to the patient.

U.S. Pat. No. 5,544,371 disclosed a "Bed patient turning, lifting and transporting apparatus with mobile, folding and knockdown frame", which is even more complicated than the device of U.S. Pat. No. 5,161,267, and has a drawback that the upper section is likely to interfere with medical staff or other people's providing service to the patient.

U.S. Pat. No. 5,673,443 disclosed an "Apparatus for turning a patient in bed", which has a longitudinal shaft 24 capable of moving a pull sheet portion 12 for turning a patient. This device is likely to interfere with medical staff or other people's providing service to the patient due to the strap elements 18, 20.

U.S. Pat. No. 6,393,636 B1 disclosed a "Patient rotation system", which is relatively uncomplicated in the structure. However, this device can only be used to turn a patient to a single side rest position, therefore the use of this device is restricted.

SUMMARY OF THE INVENTION

It is a main object of the present invention to provide a turning mechanism for a patient confined to a bed, which is relatively uncomplicated in structure, and which can be used to turn the patient to both left and right side rest positions, with little stress concentration to patient's body.

It is another object of the present invention to provide a turning mechanism for a patient confined to a bed, which can be used with little labor.

The turning mechanism of the present invention includes two pivotal frames, and two adjusting members, which are connected to respective frames provided for moving the frames between a horizontal position and a tilted one. A sheet is connected to elongated rods of the frames. The adjusting members have transmission shafts, which are connected to motors, and which have threaded sections screwed through respective moving blocks, to which propping rods are pivoted. The propping rods are pivoted to the frames at the other ends so that when the motors are activated, the moving blocks move along threaded sections, and the respective frames are adjusted with the propping rods.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
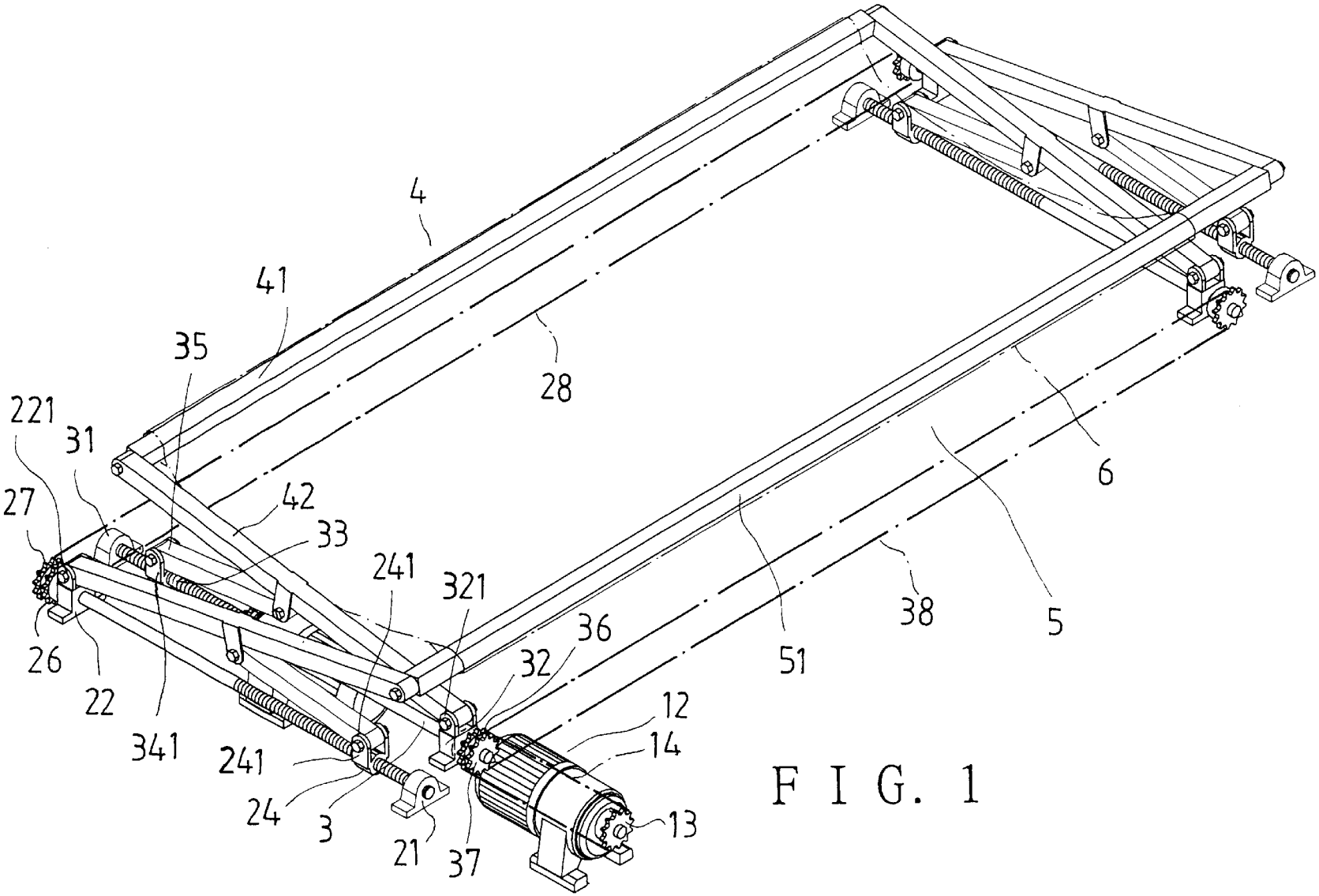
FIG. 1 is a perspective view of the turning mechanism for a patient confined to a bed according to the present invention.
Figure 2:
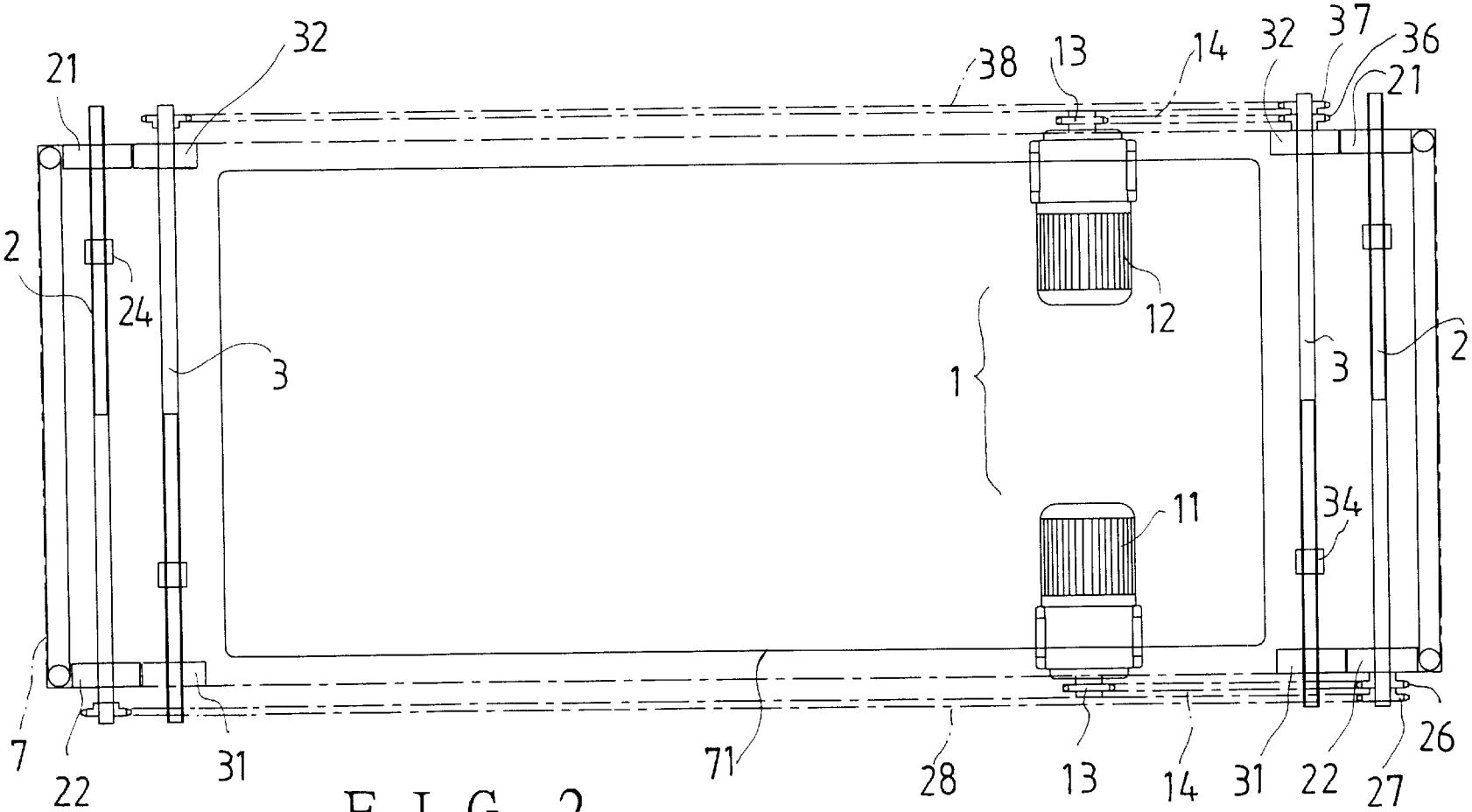
FIG. 2 is a top view of the turning mechanism for a patient confined to a bed according to the present invention.
Figure 3:
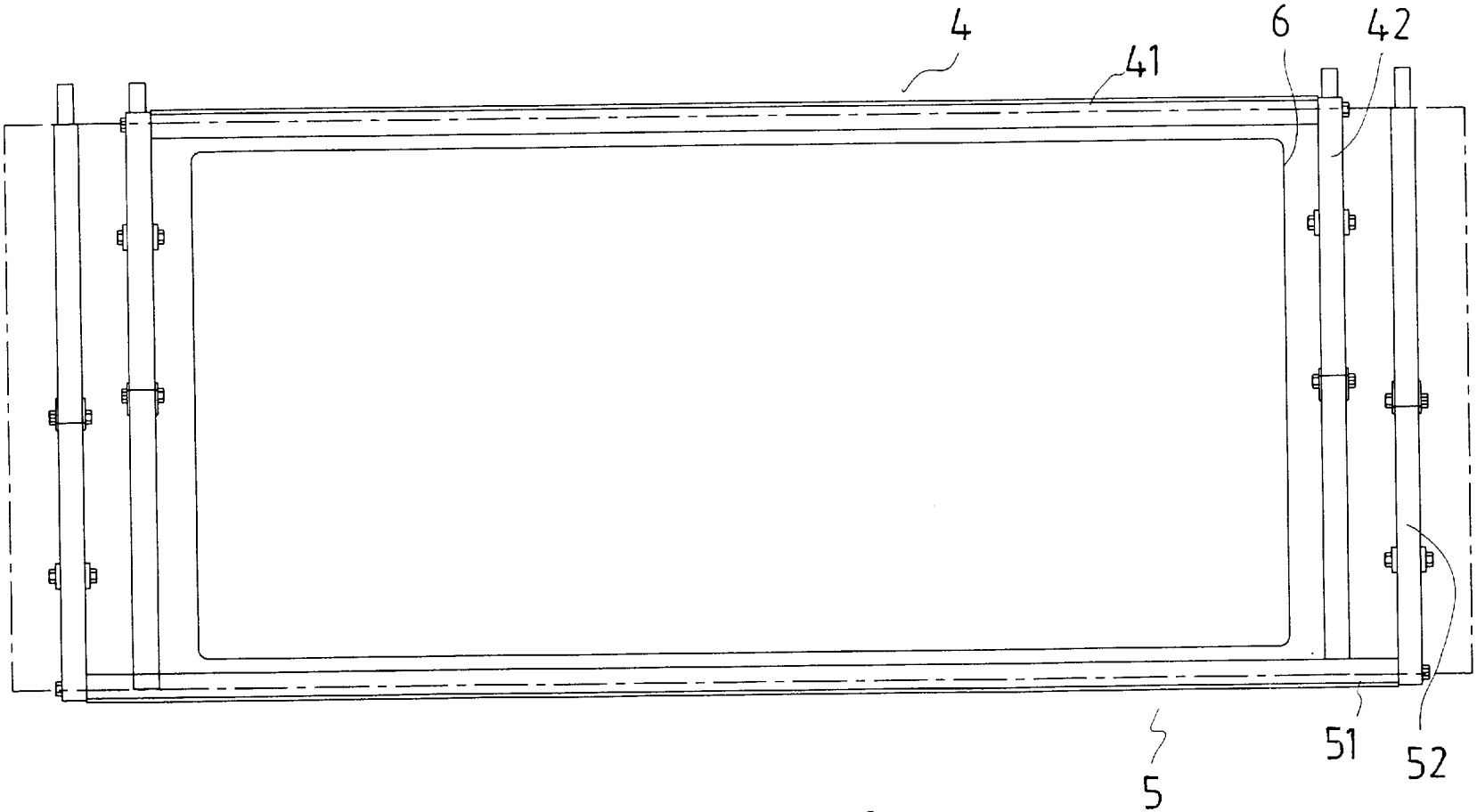
FIG. 3 is a simplified top view of the turning mechanism for a patient confined to a bed according to the present invention.
Figure 4:
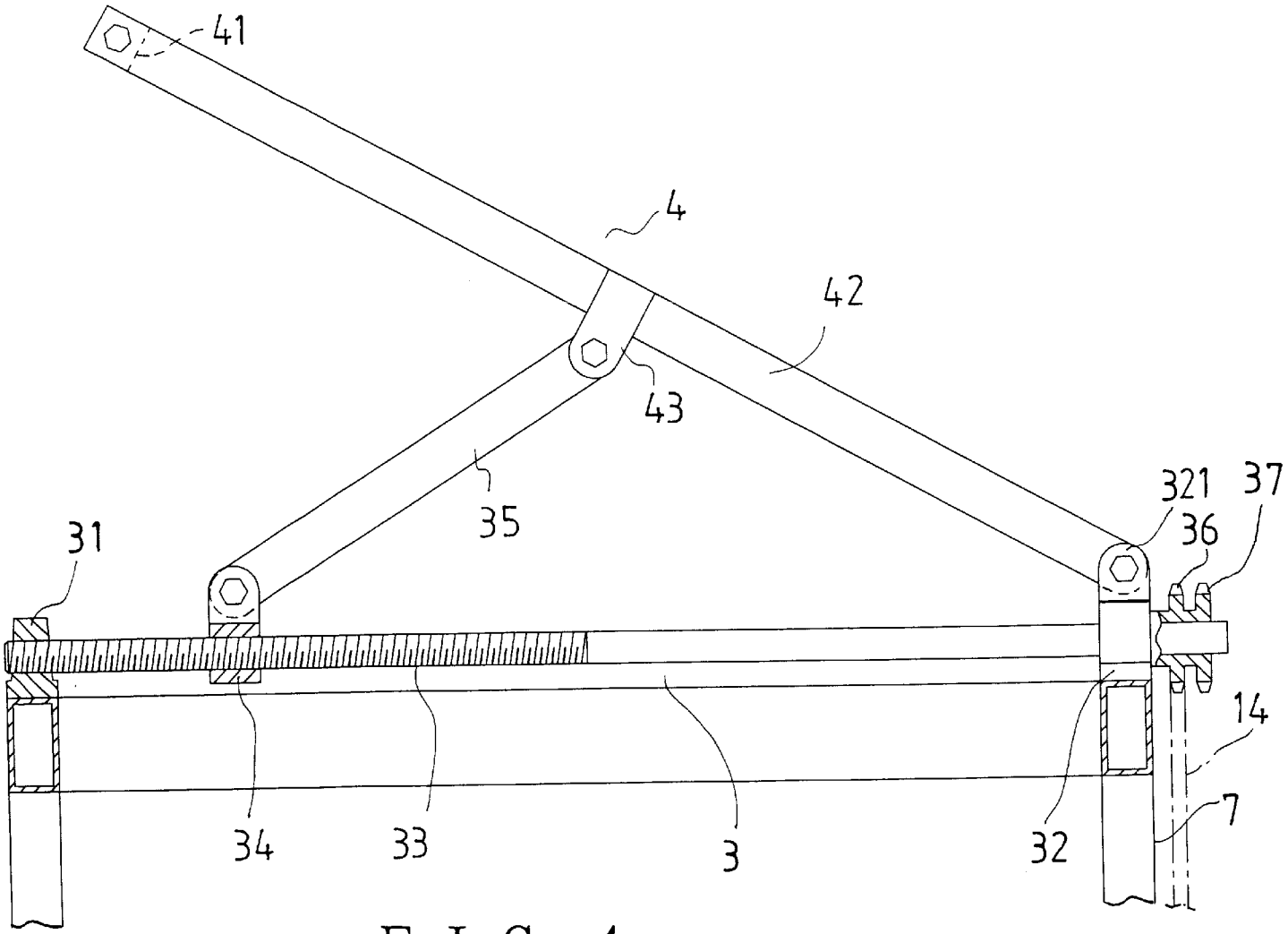
FIG. 4 is a simplified front view of the turning mechanism for a patient confined to a bed according to the present invention.
Figure 5:
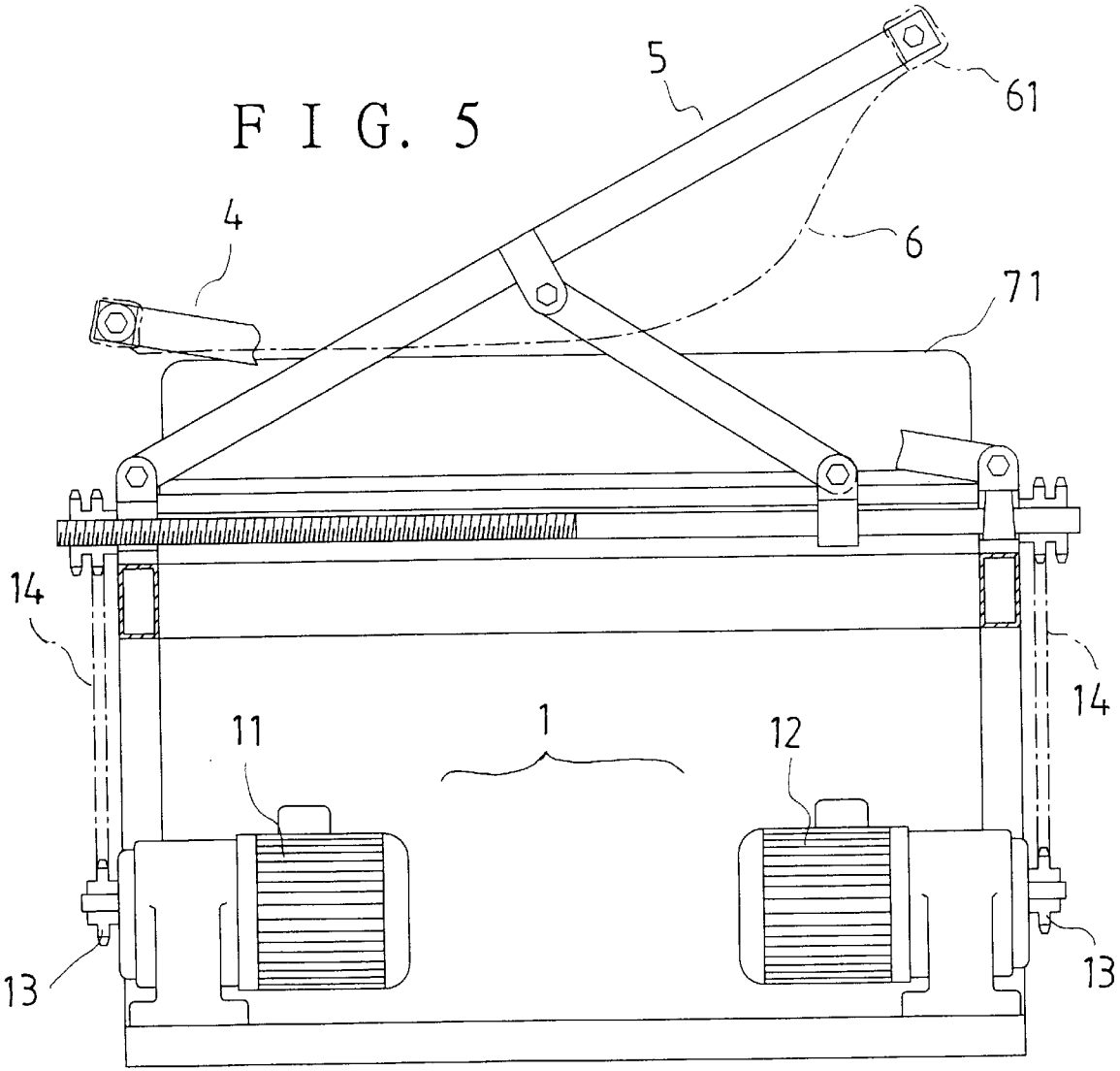
FIG. 5 is a front view of the turning mechanism for a patient confined to a bed according to the present invention; and, FIG. 6 is a fragmentary perspective view of the turning mechanism for a patient confined to a bed according to the present invention.
Figure 6:
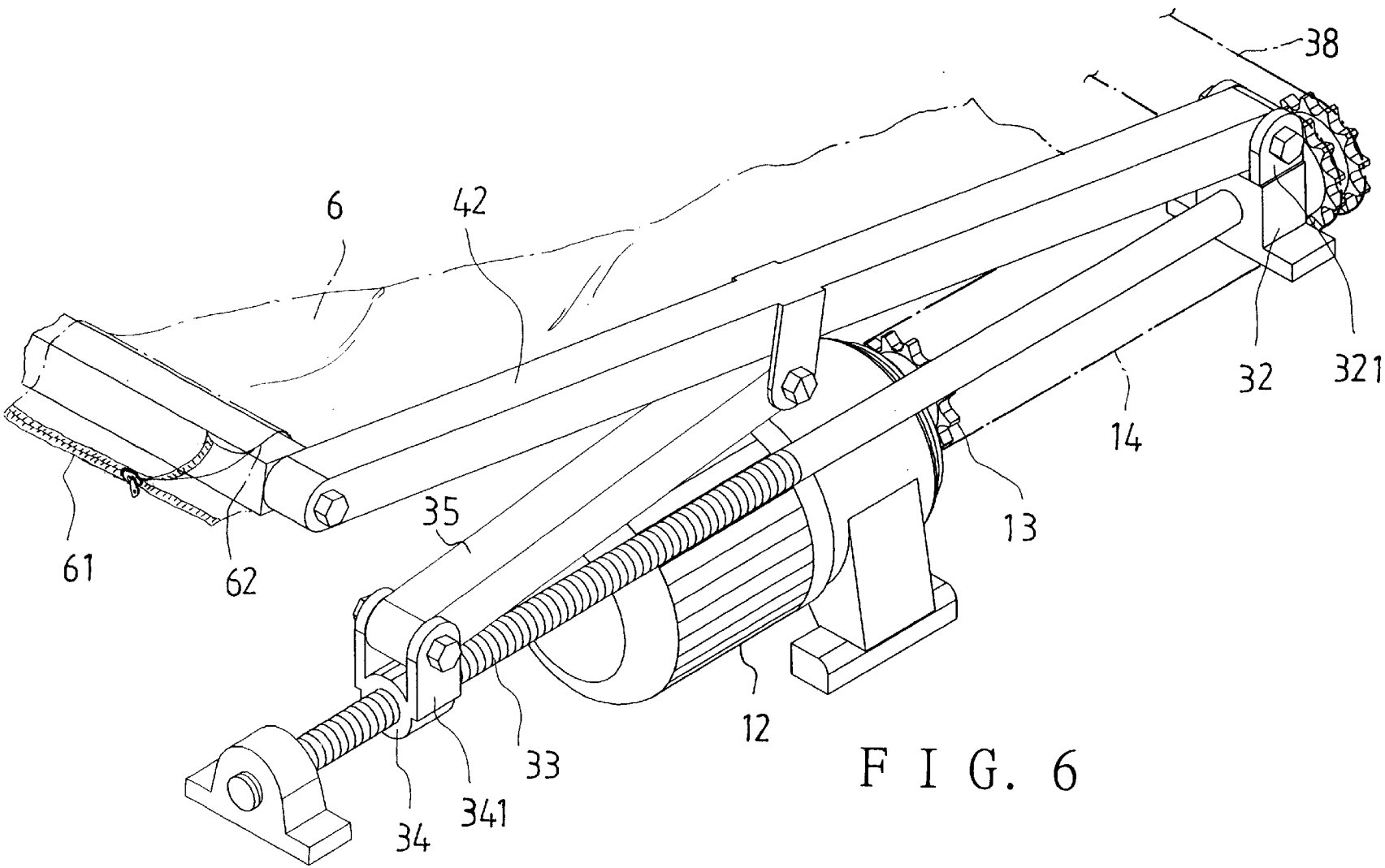

Referring to FIGS. 1, 2, and 3, a turning mechanism for a patient confined to a bed according to the present invention includes a power source 1, a first and a second movable frames 5, 4, and a first and a second adjusting members.

The power source 1 includes a left reduction gear motor 11, and a right reduction gear motor 12. The motors 11, 12 are fixedly disposed under a bed 7 or other proper places. Each of the reduction gear motors 11, 12 has a main toothed wheel 13 connected to a shaft thereof.

The movable frame 4 includes an elongated rod portion 41, and two transverse rod portions 42, 42, which are connected to two ends of the elongated rod portion 41 at upper ends thereof. The movable frame 5 includes an elongated rod portion 51, and two transverse rod portions 52, 52, which are connected to two ends of the elongated rod portion 51 at upper ends thereof. Each of the transverse rod portions 42, 52 has a pair of holed connecting ears 43, 53 sticking down from a middle portion thereof. In addition, each of the transverse rod portions 42, 52 has a pivotal hole (not numbered) at a lower end thereof.

The first, and the second adjusting members includes two propping rods 25, 25, and 35, 35, two transverse transmission shafts 2, 2, and 3, 3, a drive chain 14, and 14, a synchronizing chain 28, and 38. Each of the transverse transmission shafts 2, 2, and 3, 3 has a threaded action section 23 (33) extending from one end to the other end.

A first one of the transmission shafts 2, 2 of the first adjusting member has a first toothed wheel 26 and a second toothed wheel 27 joined to a second end thereof, which is opposite to the first end, while a second one of the transmission shafts 2, 2 has toothed wheel at the first end. Similarly, a first one of the transmission shafts 3, 3 of the second adjusting member has a first toothed wheel 36 and a second toothed wheel 37 joined to a second end thereof, which is opposite to the first end, while a second one of the transmission shafts 3, 3 has toothed wheel at the first end.

The first and the second transverse transmission shafts 2, 2 are disposed at respective ends of the bed 7, and turnably supported with support bases 21 at the first end, which have bearings for the first ends to be joined to, and are joined to bearings (not shown) fitted to shaft sleeves 22 at the second end. Similarly, the first and the second transverse transmission shafts 3, 3 of the second adjusting member are disposed at respective ends of the bed 7, and turnably supported with support bases 31 at the first end, which have bearings for the first ends to be joined to, and are joined to bearings (not shown) fitted to shaft sleeves 32 at the second end. Thus, the threaded action sections of both the transmission shafts 2, 2 are directed to a right side of the bed 7, and that the threaded action sections of both the transmission shafts 3, 3 of the second adjusting member are directed to a left side of the bed 7. Furthermore, each of the shaft sleeves 22, 32 of the transmission shafts 2, 3 has a pair of upwards sticking connecting ears 221, 321, which have pivotal holes (not numbered).

Furthermore, each of the transverse transmission shafts 2, 2, 3, 3 has a moving base 24, 34 screwed onto the threaded action section 23, 33 thereof. Each of the moving bases 24, 34 has a pair of holed connecting ears 241, 341 sticking up from it.

The drive chains 14, 14 of the first and the second adjusting members are passed over the main toothed wheels 13, 13 of the reduction gear motors 11, 12, and the second toothed wheels 27, 37 so that the motors 11, 12 can effect rotary movement of the transmission shafts 2, 3 when they are in action. The synchronizing chains 28, 38 of the first and the second adjusting members are passed over the first toothed wheels 26, 36, and the toothed wheels of the second transverse transmission shafts so that the motors 11, 12 can effect rotary movement of the second transverse shafts when they are in action.

In combination, the first and the second movable frames 5, 4, are pivotally connected to the upwards sticking connecting ears 221, 321 of the shaft sleeves 22, 32 respectively with the transverse rod portions 52, 52, 42, 42 thereof being inserted between corresponding pairs of connecting ears 221, 321, and with pivotal axles (not numbered) being passed through the pivotal holes of the connecting ears 221, 321 and the pivotal holes of the transverse rod portions 52, 52, 42, 42; thus, the elongated rod portions 51, 41 of the movable frames 5, 4, are positioned above opposite long sides of the bed 7 when the frames 5, 4, are positioned horizontal above the bed 7. Then, the propping rods 25, 35 are pivotally connected to respective pairs of downwards-sticking holed connecting ears 53, 43 of the middles of the transverse rod portions 52, 42 at the upper ends thereof, and pivotally connected to respective pairs of holed connecting ears 241, 341 of the moving bases 24, 34.

Finally, a sheet 6 is provided; each of two long sides of the sheet 6 has two connecting portions 62, 62, and zippers 61, 61 joined to the edges of the connecting portions 62, 62. Thus, the sheet 6 can be easily connected to the elongated rod portions 41, 51 of the movable frames 4, 5 with the connecting portions 62, 62 being passed around the elongated rod portions 41, 51, and with the zippers 61 being connected to each other. And, a mattress 71 is disposed under the sheet 6.

When the first and the second movable frames 5, 4 are positioned horizontal, a patient can lie on the sheet 6 in a back-rest position. To turn a patient lying on the bed 7 from the back-rest position to a left side rest position, the right reduction gear motor 11 is activated for both the transmission shafts 2, 2 of the first adjusting member to turn, and in turn, the moving bases 24 move along the threaded action sections of both the transmission shafts 2, 2 to the middles of the shafts 2. Thus, the propping rods 25 of the first adjusting member prop up the transverse rod portions 52, 52 of the movable frame 5 to a tilted position. Similarly, to turn the patient to a right side rest position, the motors 11, 12 are activated so that the movable frame 5 is pivoted to the horizontal position, and the movable frame 4 is propped up to a tilted position.

From the above description, it can be understood that the turning mechanism for a patient confined to a bed according to the present invention has desirable features as following:

1. With the left and the right reduction gear motors 11, 12 providing power to the first and the second adjusting members respectively, it is relatively easy to turn a patient on the bed.
2. Because the first and the second movable frames are connected to the first and the second adjusting members respectively, the patient on the bed can be turned to either one of both side rest positions. Therefore, the present turning mechanism can be regarded as an improvement on those conventional ones that can only turn a patient to either a left or a right side rest position.
3. Movement of the adjusting members and the movable frames is effected with the motors therefore the present turning mechanism saves a lot of labor for the nurses and people providing care to the patient.
4. The reduction gear motors provide the patient with slow and gentle turning movement, and can work together with the sheet to exert uniform force on the patient's body in turning movement. Thus, the patient won't suffer from a turning service, which is delivered manually, and would cause too much uncomfortable pressure on small portions of the patient's body.

5. The elongated rod portions of both the movable frames can be raised a short distance from the bed so that the sheet sinks slightly for preventing the patient from falling off. Therefore, the present turning mechanism for a patient is safe to use. The normal side rails of bed can also be applied for double safety.

6. Because the sheet is equipped with zippers for connection with the elongated rod portions of both the movable frames, it can be easily removed from the present turning mechanism for cleaning.

What is claimed is:

1. A turning mechanism for a patient confined to a bed, comprising a power source including a left and a right power elements;

a first and a second movable frames disposed on a bed, and each including an elongated rod portion, and two transverse rod portions connected to the elongated rod portion at upper ends thereof; the movable frames being pivotally connected to a bed at lower ends of the transverse rod portions to be pivotal between a tilted position and a horizontal one where the elongated rod portions are substantially faced with respective ones of two opposite long sides of the bed;

a first and a second adjusting members each including:

(a) two propping rods;

(b) first and second transverse transmission shafts disposed at opposite ends of the bed; the transverse transmission shafts having two ends turnably supported with supporting elements, which are fixedly joined to respective ones of opposite long sides of the bed; the first transmission shaft being equipped with a first and a second toothed wheels at one end thereof; the second transmission shaft being equipped with a toothed wheel at one end;

(c) two moving bases movably connected to respective transmission shafts;

(d) a drive chain connected to the first toothed wheel of the first transverse transmission shaft and a corresponding power element for passing on rotary movement of the power element to the first transmission shaft; and, (e) a synchronizing chain passed over both the toothed wheel of the second transverse shaft and the second toothed wheel of the first transverse shaft for passing on movement of the first transmission shaft to the second shaft;

the propping rods of the adjusting members being pivotally connected to middle portions of corresponding transverse rod portions of the movable frames at upper ends thereof; the propping rods of the adjusting members being pivotally connected to corresponding moving bases at lower ends thereof so that the moving bases move along respective transmission shafts to adjust position of the propping rods relative to corresponding movable frames when the corresponding power elements are in action, and in turn, the movable frames are adjusted in position;

a sheet being connected to the elongated rod portions of the movable frames at two opposite long sides thereof.

2. The turning mechanism for a patient confined to a bed as claimed in claim 1, wherein the power elements are reduction gear motors each having a main toothed wheel, and the drive chains of the adjusting members are passed over respective first toothed wheel of the first transverse transmission shafts and respective main toothed wheel.

3. The turning mechanism for a patient confined to a bed as claimed in claim 1, wherein each of the transmission shafts each has a threaded action section, and the moving bases are screwed onto respective threaded action sections so that they can move along the threaded action sections when the power elements are actuated to effect rotary movement of the transmission shafts.

4. The turning mechanism for a patient confined to a bed as claimed in claim 1, wherein the transverse rod portions of the movable frames, and the moving bases have holed connecting ears projecting therefrom for the upper and the lower ends of the propping rods to be pivotally connected thereto respectively.

5. The turning mechanism for a patient confined to a bed as claimed in claim 1, wherein holed connecting ears are formed on those of the supporting elements that the lower ends of the transverse rod portions of the movable frames are pivotally connected to for the pivotal connection.

6. The turning mechanism for a patient confined to a bed as claimed in claim 1, wherein each of the long sides of the sheet has two connecting portions, and two zippers joined to edges of respective connecting portions so that the sheet can be connected to the elongated rod portions of the movable frames with the connecting portions being passed around the elongated rod portions, and with corresponding zippers being connected to each other.

7. A turning mechanism for a patient confined to a bed, comprising a power source including a left and a right reduction gear motors fixedly connected to a bed; each of the reduction gear motors having a main toothed wheel connected to a shaft thereof;

a first and a second movable frames disposed on a bed, and each including an elongated rod portion, and two transverse rod portions connected to the elongated rod portion at upper ends thereof; the movable frames being pivotally connected to a bed at lower ends of the transverse rod portions to be pivotal between a tilted position and a horizontal one where the elongated rod portions are substantially faced with respective ones of two opposite long sides of the bed;

a first and a second adjusting members each including:

(a) two propping rods;

(b) first and second transverse transmission shafts disposed at opposite ends of the bed; the transverse transmission shafts having two ends turnably supported with supporting elements, which are fixedly joined to respective ones of opposite long sides of the bed; the first transmission shaft being equipped with a first and a second toothed wheels at one end thereof; the second transmission shaft being equipped with a toothed wheel; the transmission shafts each having a threaded action section;

(c) two moving bases screwed onto respective threaded action sections of the transmission shafts;

(d) a drive chain passed over both the first toothed wheel of the first transverse transmission shaft and the main toothed wheel of a corresponding reduction gear motor for passing on rotary movement of the reduction gear motor to the first transmission shaft; and, (e) a synchronizing chain passed over both the toothed wheel of the second transverse shaft and the second toothed wheel of the first transverse shaft for passing on movement of the first transmission shaft to the second transverse shaft;

the propping rods of the adjusting members being pivotally connected to middle portions of transverse rod portions of corresponding movable frames at upper ends thereof; the propping rods of the adjusting members being pivotally connected to corresponding moving bases at lower ends thereof so that the moving bases move along respective threaded action sections to adjust position of the propping rods relative to corresponding movable frames when the corresponding motors are in action, and in turn, the movable frames are adjusted between a horizontal position and a tilted one;

a sheet being connected to the elongated rod portions of the movable frames at two opposite long sides thereof.

8. The turning mechanism for a patient confined to a bed as claimed in claim 7, wherein each of the transverse rod portions of the movable frames has a pair of holed connecting ears sticking down from it for an upper end of a corresponding propping rod to be passed into between, and pivoted to, and each of the moving bases has a pair of holed connecting ears sticking up from it for a lower end of a corresponding propping rod to be passed into between, and pivoted to.

9. The turning mechanism for a patient confined to a bed as claimed in claim 7, wherein a pair of upwards sticking holed connecting ears are formed on each of those supporting elements to which the lower ends of the transverse rod portions are pivoted, and the lower ends of the transverse rod portions are passed into between, and pivoted to, respective pairs of upwards sticking holed connecting ears.

10. The turning mechanism for a patient confined to a bed as claimed in claim 7, wherein each of the long sides of the sheet has two connecting portions, and two zippers joined to edges of respective connecting portions so that the sheet can be connected to the elongated rod portions of the movable frames with the connecting portions being passed around the elongated rod portions, and with corresponding zippers being connected to each other.

* * * * *